US007255182B1

(12) United States Patent
Ware

(10) Patent No.: US 7,255,182 B1
(45) Date of Patent: Aug. 14, 2007

(54) GROUND DRILLING TOOL

(76) Inventor: David N. Ware, 9709 Highway 142, Newborn, GA (US) 30056

( * ) Notice: Subject to any disclaimer, the term of this patent is extended or adjusted under 35 U.S.C. 154(b) by 165 days.

(21) Appl. No.: 10/764,659

(22) Filed: Jan. 26, 2004

(51) Int. Cl.
*E21B 10/36* (2006.01)

(52) U.S. Cl. ..... 175/293; 175/401; 175/415

(58) Field of Classification Search ..... 175/401, 175/307, 295, 189, 293, 320, 389, 395, 407, 175/414, 415, 19, 53
See application file for complete search history.

(56) References Cited

U.S. PATENT DOCUMENTS 1,899,728 A * 2/1933 Sandstone ..... 175/232
2,221,242 A * 11/1940 McCielland ..... 175/227
2,234,454 A * 3/1941 Richter ..... 175/215
2,288,124 A 6/1942 Creighton
2,425,012 A * 8/1947 Synder ..... 175/295
2,495,073 A 1/1950 Morris
2,738,165 A * 3/1956 McNatt ..... 175/308
2,790,623 A * 4/1957 Pate et al. ..... 175/295
3,313,364 A * 4/1967 Binkley ..... 175/325.2
3,399,741 A * 9/1968 Monroe ..... 175/297
3,480,094 A 11/1969 Morris
3,837,414 A * 9/1974 Swindle ..... 175/299
4,986,375 A 1/1991 Maher

* cited by examiner

*Primary Examiner*—Kenneth Thompson
(74) *Attorney, Agent, or Firm*—Baker Donelson

(57) ABSTRACT

A back bit (20) is disclosed which is to used in conjunction with drilling equipment (10) which may include a derrick (11), a drilling pipe (12), a back head (14), a starting rod (13), and a cutting bit (15) mounted to the lower end of the starting rod. The back bit has a tubular body (21) with a plurality of upwardly extending cutting teeth (22).

8 Claims, 3 Drawing Sheets

GROUND DRILLING TOOL

TECHNICAL FIELD

This invention relates to earthen formation drilling tools and specifically to earthen formation drill tools having an improvement for extracting the drill bit and related components.

BACKGROUND OF THE INVENTION

Large drilling equipment has been used for many years to bore holes deep into the earth or earthen formations. Such drilling equipment typically includes a derrick or mounting frame which controls the positioning and rotation of a drill pipe. The drill pipe has a bottommost section called a starting rod which is coupled to a hammer through a back head. The bottom of the hammer has a cutting head or drill bit. The drill pipe, starting rod, back head, hammer, and cutting bit are hollow so that fluids pass through the them under great pressure so that fluids can be expelled from the drill bit during use. The pressurized fluid is utilized to force freshly formed debris, such as dirt and cuttings which the drill bit has loosened, from the bored hole to the earth's surface.

The drill bit forms a bore or hole larger in diameter than the drill pipe to provide a channel through which the fluid and debris can reach the surface. However, oftentimes the debris becomes lodged within the channel between the drill pipe and the sidewalls of the bore. Also, the side walls oftentimes partially collapse or shift thereby causing debris to fall within the channel. This debris can cause complications or even the prevention of the removal of the drill bit and related piping from the bore once the bore is completed. Additionally, the debris can cause the frictional wearing of the starting rod, back head or hammer as they are rotated during its extraction.

It thus is seen that a need remains for a drilling tool that will facilitate the extraction of the drill pipe and related components from the earth. Accordingly, it is to the provision of such that the present invention is primarily directed.

SUMMARY OF THE INVENTION

In a preferred form of the invention, a ground drilling tool for use in conjunction with a length of drilling pipe comprises a hammer having a lower end and an upper end adapted to be coupled to a length of drilling pipe through a back head, a drill cutting bit coupled to the lower end of the hammer, and a back bit extending from the back head, the back bit has a plurality of upwardly extending cutting teeth. With this construction, the drill cutting bit creates a bore in the ground as it is moved downwardly and the back bit recuts the bore as it is moved upwardly should debris fall within the bore.

DETAILED DESCRIPTION

Figure 1:
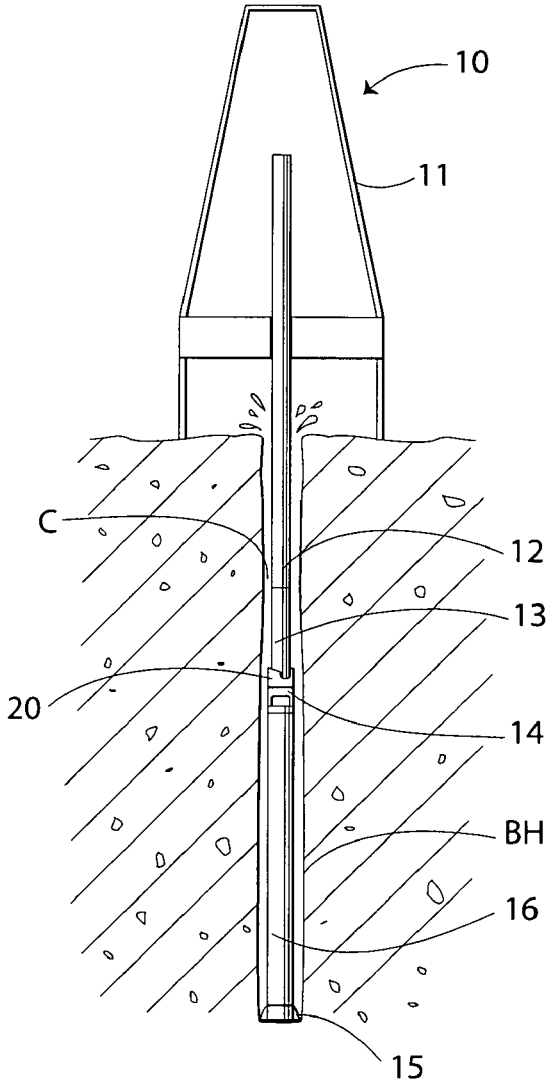
FIG. 1 is a side view of drilling equipment utilized in practicing the principles of the invention in a preferred form.
Figure 2:
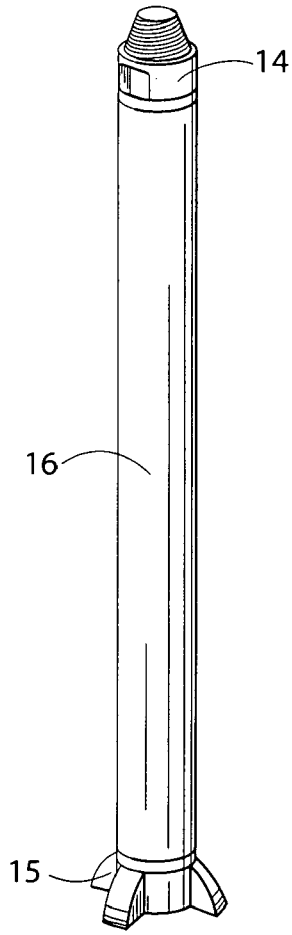
FIG. 2 is a perspective view of a drill pipe hammer, back head, and drill bit.
Figure 3:
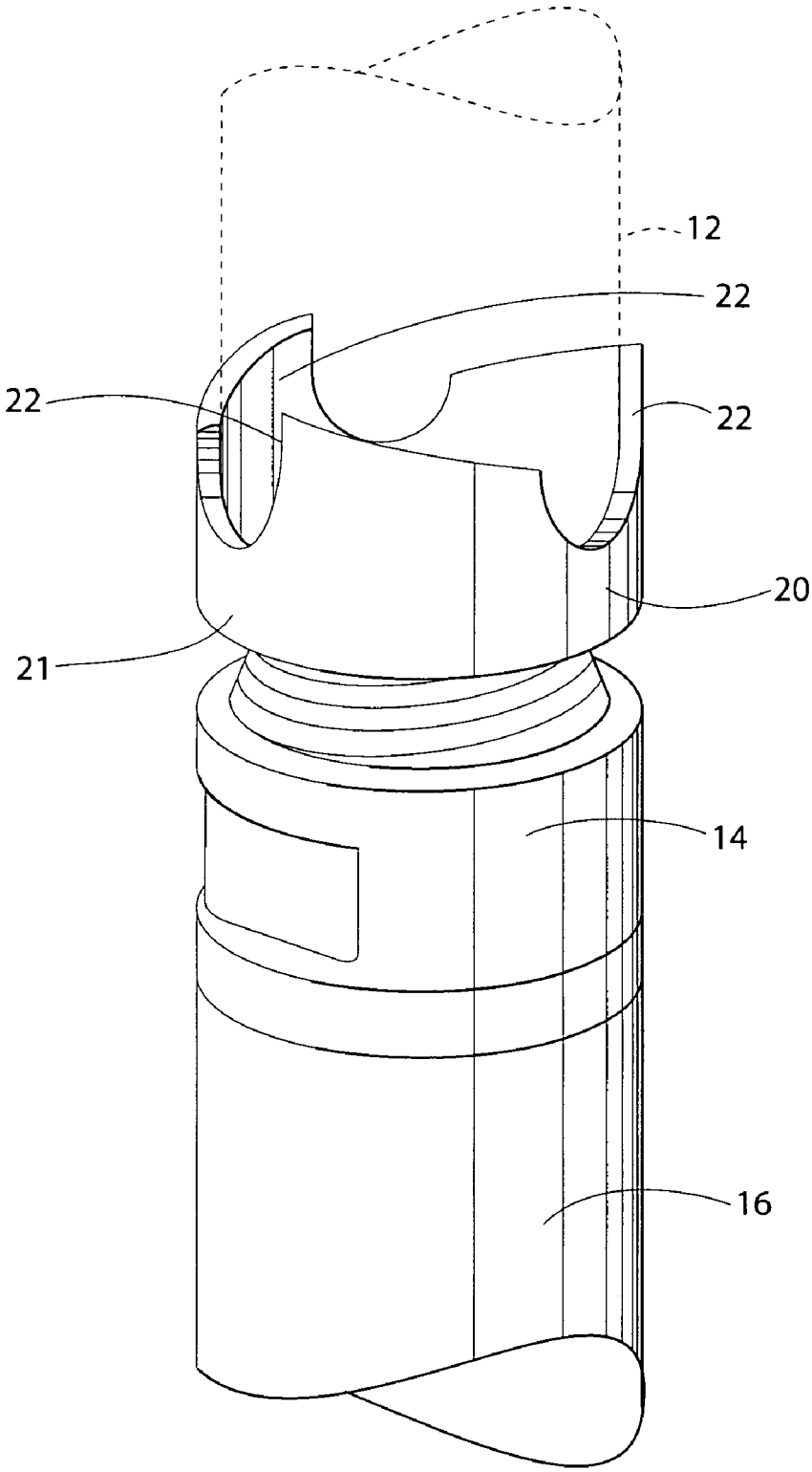
FIG. 3 is a perspective, exploded view of a drilling tool embodying principles of the invention.

With reference next to the drawings, there is shown drilling equipment 10 including a derrick 11, and a length of drilling pipe 12 terminating with a starting rod 13. The bottom of the starting rod 13 is threaded onto the top end of a back head 14. A hammer 16 is threaded onto the bottom end of the back head 14. The hammer 16 has a lower end terminating with a drill cutting bit 15. The drilling pipe 12, starting rod 13, back head 14, hammer 16 and cutting bit 15 all include a central flush channel which carries pressurized fluid to the drill cutting bit 15 as conventionally known in the art. As such, the drilling equipment also includes unshown conventional fluid pressuring means which produces and conveys pressurized fluid through the flush channel and means for rotating and moving the drilling pipe in the vertical direction during drilling.

A back bit 20 embodying principles of the invention in a preferred form is shown mounted to the upper end of the back head, the combination of the back bit 20, back head 14 and the starting rod 13, or a combination thereof, may be referred herein as a drilling tool. The back bit 20 has a tubular body 21 with a plurality of upwardly extending cutting teeth 22. The number and shape of the cutting teeth 22 may be selected depending upon the composition of the earthen material through which the drill passes, the length of the bore which is drilled, and the desired speed of drill rotation during extraction. The back bit 20 may be coupled to the starting rod by welding it to the bottom end of the starting rod, to the top end of the back head, or the top end of the hammer 16. It may also be mounted by providing set screws extending through the body 21 and bearing against the starting rod, back head or hammer, or by any other conventionally known method of attaching a collar or sleeve to a length of pipe.

Figure 7:
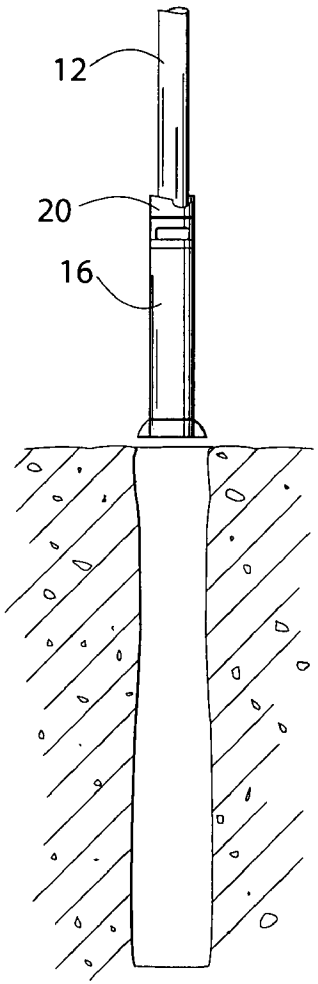
FIGS. 4-7 are a series of sequential side views illustrating the drilling equipment in use.
Figure 6:
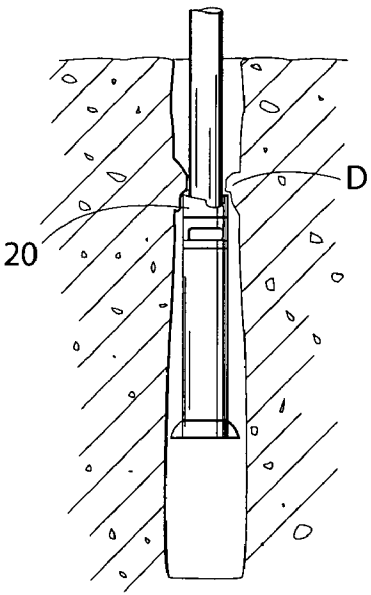
Figure 5:
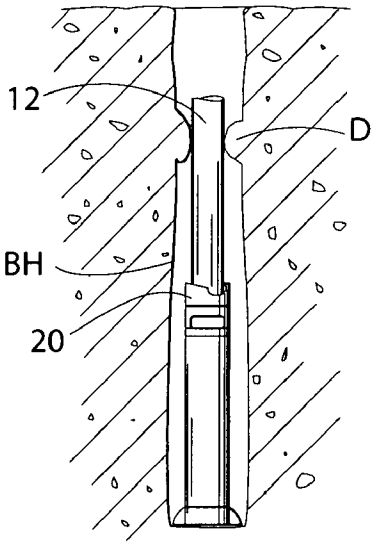
Figure 4:
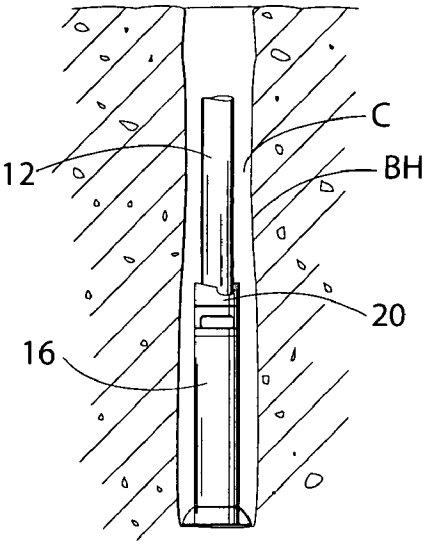

In use, the back bit 20 is mounted to the upper end of the back head so that the cutting teeth 22 surround the lower end of the starting rod. The back bit 20 is fixedly mounted to the back head so that it is prevented from rotating relative to the starting rod 13 and hammer 16. An operator may then drill a bore hole BH in the ground to a desired depth, as shown in FIG. 4. Once the desired bore depth is reached the drilling pipe 12 is extracted from the bore hole by raising the drilling pipe 12 vertically while simultaneously continuing its rotation. As shown in FIG. 5, debris D may form within channel C between the drilling pipe 12 and the sidewalls of the bore hole. Should this occur, as the drilling pipe is raised the teeth 22 of the back bit 20 encounters the debris D and erodes it through the rotational and upward movement of the back bit 20, as shown in FIG. 6. This motion causes the back bit 20 to create a new bore or reverse bore which allows the passage of the back head and hammer through the debris until the hammer is extracted from the ground, as shown in FIG. 7.

The term hammer as used herein, including the claims, may include the hammer alone or the hammer in combination with the back head, wear sleeve, starting rod or any combination thereof.

It thus should be understood that the present invention allows an operator to not only drill downwardly into the ground but also re-drill the bore should debris become lodged within the bore. This enables an operator to recover drilling equipment that may have become lost within the bore due to its inability to be extracted.

It should also be understood that the back bit may be mounted in other positions along the drilling pipe. Furthermore, it should be understood that the present invention also incorporates a hammer or back head having a back bit integrally incorporated or extending therefrom, i.e., these components may have upwardly extending cutting teeth or an upwardly extending cutting bit, or a starting rod having a lowermost section incorporating upwardly extending cutting teeth. It should also be understood that the term cutting teeth as used herein is meant to include any type of conventionally know earthen boring devices such as grinding cones, grinding wheels, or the like. Lastly, it should be understood that the present invention may be used in conjunction with an additional, conventional wear sleeve.

It thus is seen that a drilling tool having a back bit for drilling is now provided which can bore or re-bore a hole in the ground should the bore hole become blocked with debris during the drilling process. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A rotatable ground drilling tool for use in conjunction with a length of rotating drilling pipe, the drilling tool comprising:

a hammer having a lower end and an upper end adapted to be coupled to the length of drilling pipe through a back head;

a drill cutting bit coupled to said lower end of said hammer, said drill cutting bit being designed to rotatably cut through ground through rotational movement of said drill cutting bit; and a back bit extending from said back head, said back bit having a plurality of upwardly extending cutting teeth configured to rotatable cut through ground debris as said back bit is rotated, whereby the drill cutting bit creates a bore in the ground as it is moved downwardly while being simultaneously rotated and the back bit recuts the bore as it is moved upwardly and simultaneously rotated should debris fall within the bore.

2. The rotatable ground drilling tool of claim 1 wherein said back bit is permanently affixed to said back head.

3. In combination with ground drilling equipment including a length of rotating drilling pipe, a hammer and a downward cutting bit, the improvement comprising a rotatable back bit coupled to said hammer, said rotatable back bit having a plurality of upwardly extending cutting teeth, said teeth being configured to rotatably cut through debris through rotational movement of said back bit, whereby the drill cutting bit creates a bore in the ground as it is moved downwardly and the back bit recuts the bore as it is moved upwardly should debris fall within the bore.

4. The combination of claim 3 wherein said back bit is mounted to an upper end of said hammer.

5. The combination of claim 3 wherein said hammer includes a back head and wherein said back bit is mounted to said back head.

6. A rotatable ground drilling tool for use in conjunction with a length of rotating drilling pipe and a hammer having a rotatable cutting bit at one end, the drilling tool comprising a tubular body coupled to said hammer opposite the cutting bit, and a plurality of upwardly extending earth cutting means configured to rotatable cut through debris through rotational movement of said earth cutting means, whereby the cutting bit creates a bore in the ground as it is rotated and moved downwardly and the drilling tool recuts the bore as it is rotated and moved upwardly should debris fall within the bore.

7. The rotatable ground drilling tool of claim 6 wherein said earth cutting means comprises a cutting teeth.

8. The rotatable ground drilling tool of claim 6 wherein said hammer includes a back head and wherein said back bit is mounted to said back head.

* * * * *